US009683720B2

(12) United States Patent
Peng et al.

(10) Patent No.: US 9,683,720 B2
(45) Date of Patent: Jun. 20, 2017

(54) REFLECTING STRUCTURE FOR LAMP

(71) Applicant: Taiwan Network Computer & Electronic Co., Ltd., New Taipei (TW)

(72) Inventors: Chia-Mei Peng, Ping-Chen (TW); Hsieh-Chen Chuang, New Taipei (TW); Ping-Han Chuang, New Taipei (TW)

(73) Assignee: TAIWAN NETWORK COMPUTER & ELECTRONIC CO., LTD., New Taipei (TW)

( * ) Notice: Subject to any disclaimer, the term of this patent is extended or adjusted under 35 U.S.C. 154(b) by 156 days.

(21) Appl. No.: 14/822,812

(22) Filed: Aug. 10, 2015

(65) Prior Publication Data

US 2017/0045202 A1 Feb. 16, 2017

(51) Int. Cl.

| | |
|---|---|
| ***F21V 13/04*** | (2006.01) |
| ***F21S 8/10*** | (2006.01) |
| ***F21V 7/04*** | (2006.01) |
| ***F21V 7/09*** | (2006.01) |
| ***F21V 15/01*** | (2006.01) |

(52) U.S. Cl.

CPC ..... *F21V 13/04* (2013.01); *F21S 48/137* (2013.01); *F21S 48/1376* (2013.01); *F21V 7/04* (2013.01); *F21V 7/048* (2013.01); *F21V 7/09* (2013.01); *F21V 15/01* (2013.01)

(58) Field of Classification Search

CPC ... B60Q 1/04; F21V 7/00; F21V 7/048; F21V 7/09; F21V 13/04; F21V 15/01; F21V 7/04; F21S 48/1317; F21S 48/1335; F21S 48/1352; F21S 48/137; F21S 48/1376; F21S 48/1388

See application file for complete search history.

(56) References Cited

U.S. PATENT DOCUMENTS

| | | | | |
|---|---|---|---|---|
| 1,814,326 A * | 7/1931 | Melton | ..... | F21S 48/1317 362/235 |
| 2,068,781 A * | 1/1937 | Wendel | ..... | F21V 7/09 362/296.06 |
| 2016/0230959 A1* | 8/2016 | Peng | ..... | F21V 7/09 |

* cited by examiner

*Primary Examiner* — Hargobind S Sawhney
(74) *Attorney, Agent, or Firm* — Guice Patents PLLC

(57) ABSTRACT

A reflecting structure includes at least one light source; and a reflector, in which the light source is disposed to emit light, including at least one light intercepting plate and a main body, wherein the light intercepting plate includes an inner surface which is a plane serving as a light intercepting surface intercepting the light from the light source, at least one reflecting surface extending from the light intercepting surface and perpendicularly toward an outer surface of the light intercepting plate and at least one positioning structure; the main body is joined to the light intercepting surface and includes at least two convex curved surfaces disposed on two opposite sides of a vertical line extending through the light source to reflect light from the light source directly and the light reflected by the light intercepting surface.

23 Claims, 18 Drawing Sheets

REFLECTING STRUCTURE FOR LAMP

BACKGROUND OF THE INVENTION

Field of the Invention

The invention relates to a reflecting structure for a lamp, and in particular to a lamp used in vehicles and streets and reflecting all light to a region to be illuminated, wherein an illuminating range is adjustable.

Description of the Related Art

Referring to FIGS. 1A and 1B, two conventional reflecting structures are depicted. A reflector B01 shown in FIG. 1A includes a light intercepting plate 101 which includes a light intercepting surface 102. At least one arced reflecting surface 103 is disposed on the light intercepting surface 102. A main body 104 is disposed under the light intercepting plate 102. The main body 104 includes a conical curved reflecting surface 112. A light source 105 is disposed at the top of the reflector B01 through a hole. The reflector B02 as shown in FIG. 1B includes a light intercepting plate 106. The light intercepting plate 106 includes a light intercepting surface 107. An arced reflecting surface 108 is disposed on the light intercepting surface 107. A conical curved reflecting surface 109 is disposed in front of the arced reflecting surface 108. A main body 110 is disposed under the light intercepting plate 106. The main body 106 includes a top conical curved reflecting surface 114, a middle semi-circular plate 115 and a bottom conical curved reflecting surface 113. A light source 111 is disposed on the top of the reflector B02 through a hole.

Although the reflecting structures prevent light from dazzling eyes of a driver in a coming vehicle and control the illuminating range of a lamp so as to raise illuminating efficiency, the illuminating range is semi-circular which is a kind of and cannot satisfy illuminating ranges of various vehicles.

BRIEF SUMMARY OF THE INVENTION

An object of the invention is to provide a reflecting structure providing a controllable illuminating range.

Another object of the invention is to provide a reflecting structure providing an illuminating range with uniform brightness.

Another object of the invention is to provide a reflecting structure to enhance the brightness in some specific regions.

The invention provides a reflecting structure. The reflecting structure in accordance with an exemplary embodiment of the invention includes at least one light source; and a reflector, in which the light source is disposed to emit light, including at least one light intercepting plate and a main body, wherein the light intercepting plate includes an inner surface which is a plane serving as a light intercepting surface intercepting the light from the light source, at least one reflecting surface extending from the light intercepting surface and perpendicularly toward an outer surface of the light intercepting plate and at least one positioning structure; the main body is joined to the light intercepting surface and includes at least two convex curved surfaces disposed on two opposite sides of a vertical line extending through the light source to reflect light from the light source directly and the light reflected by the light intercepting surface.

In another exemplary embodiment, each of the convex curved surface includes a plurality of curved surfaces connected to each other, each of the curved surfaces has an inclined angle different from the inclined angle of others of the curved surfaces, each of the curved surfaces is disposed horizontally and curved from a bottom to a central line of the reflector, the curved surface is gradually inclined toward a base point from the curved surface disposed in the most top position to a curved surface in the most bottom position, the base point is formed by a vertical line parallel to a vertical central line of the light source intersecting a lower edge of the reflector, the inclined angle and a length of the curved surface is gradually increased from the curved surface disposed in the most top position to a curved surface in the most bottom position, and the main body includes at least one positioning structure.

In yet another exemplary embodiment, the light intercepting surface includes at least one horizontal light intercepting surface and at least one inclined light intercepting surface, the inclined light intercepting surface includes a conical curved reflecting surface, the conical reflecting surface includes a plurality of arced inclined surface connected to each other, each of the arced inclined surface has an inclined angle different from the inclined angle of other of the arced inclined surfaces, the inclined angle of the arced inclined surface is gradually increased from the bottom of the reflector to the arced inclined surface in a top position of the conical reflecting surface.

In another exemplary embodiment, the light intercepting plate includes at least one horizontal light intercepting surface and at least one vertical light intercepting surface perpendicular to the horizontal light intercepting surface and disposed on an inner surface of a bottom of the light intercepting plate.

In yet another exemplary embodiment, the reflecting surface is an arced surface.

In another exemplary embodiment, the reflecting surface is a curved surface.

In yet another exemplary embodiment, the reflecting surface includes at least two convex curved surfaces disposed on opposite sides of a vertical line extending through the light source, each of the convex curved surface includes a plurality of curved surfaces connected to each other, each of the curved surfaces has an inclined angle different from the inclined angle of others of the curved surfaces, each of the curved surfaces is disposed horizontally and curved from a bottom to a central line of the reflector, the curved surface is gradually inclined toward a base point from the curved surface disposed in the most bottom position to a curved surface in the most top position, the base point is formed by a vertical line parallel to a vertical central line of the light source intersecting a lower edge of the reflector, the inclined angle of the curved surface is gradually increased from the curved surface disposed in the most bottom position to a curved surface in the most top position, and a length of the curved surface is gradually decreased from the curved surface disposed in the most bottom position to a curved surface in the most top position.

In another exemplary embodiment, the reflecting surface further includes a stripped reflecting surface disposed between the convex curved surfaces, the stripped reflecting surface includes a plurality of inclined surfaces connected to each other, each of the inclined surfaces has an inclined angle different from the inclined angle of others of the inclined surfaces, and the inclined angle of the inclined surface is gradually increased from the inclined surface in the most bottom position to the inclined surface in the most top position.

In yet another exemplary embodiment, the reflecting surface further includes an arced surface connecting the convex curved surfaces disposed in a top position of the light intercepting plate.

In another exemplary embodiment, the reflecting surface includes at least one arced surface and at least one convex curved surface extending from the light intercepting surface perpendicularly toward an outer surface of the light intercepting plate, the convex curved surface is disposed on a lateral side of a vertical light intercepting surface extending through a plurality of vertical lines parallel to a vertical line extending through the light source and perpendicular to the light intercepting surface, the convex curved surface includes a plurality of curved surfaces connected to each other, each of the curved surface is disposed horizontally, curved from a bottom of the reflector to a central line of the reflector, and has an inclined angle different from the inclined angle of others of the curved surface, the curved surface is gradually inclined toward a base point from the curved surface disposed in the most bottom position to a curved surface in the most top position, the base point is formed by a vertical line parallel to a vertical central line of the light source intersecting a lower edge of the reflector, the inclined angle of the curved surface is gradually increased from the curved surface disposed in the most bottom position to a curved surface in the most top position, and a length of the curved surface is gradually decreased from the curved surface disposed in the most bottom position to a curved surface in the most top position.

In yet another exemplary embodiment, the main body further includes an arced surface connecting the convex curved surfaces.

In another exemplary embodiment, the main body further includes a stripped reflecting surface disposed between the convex curved surfaces and connecting the convex curved surfaces, the stripped reflecting surface includes a plurality of inclined surfaces, each of the inclined surface has an inclined angle different from the inclined angle of others of the inclined surfaces, and the inclined angle of the inclined surface is gradually increased from the inclined surface in the most bottom position to the inclined surface in the most top position.

In yet another exemplary embodiment, the main body further includes an arced surface connecting the convex curved surfaces and the stripped reflecting surface.

In another exemplary embodiment, the light intercepting plate includes at least one positioning structure, each of the convex curved surfaces includes a positioning structure, the light intercepting plate and one of the convex curved surfaces of the main body is fixed to an anti-dust cover including at least one optical transparent plate, the other convex curved surface is movably disposed on the positioning structure and connected to a solenoidal valve.

In yet another exemplary embodiment, the reflector includes a decoration panel disposed on a bottom of the reflector and extending outward, and a warning light source is disposed on the decoration panel.

In another exemplary embodiment, the reflector includes at least one positioning structure including through holes for mounting the light source.

In yet another exemplary embodiment, the light intercepting plate is integrated with the main body and includes at least one positioning structure.

In another exemplary embodiment, the reflector is assembled with at least one light emitting module.

In yet another exemplary embodiment, the reflector is assembled with at least one transparent plate.

In another exemplary embodiment, the reflector has a stepped structure on a bottom of the reflector.

In yet another exemplary embodiment, the reflector includes a plurality of fins disposed on the outer surface of the light intercepting plate.

In another exemplary embodiment, the reflector is disposed upside down in an anti-dust cover including at least one transparent plate.

In yet another exemplary embodiment, the reflector is assembled with an end surface of a hollow frame, and another end surface of the hollow frame is assembled with a lens.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1B:
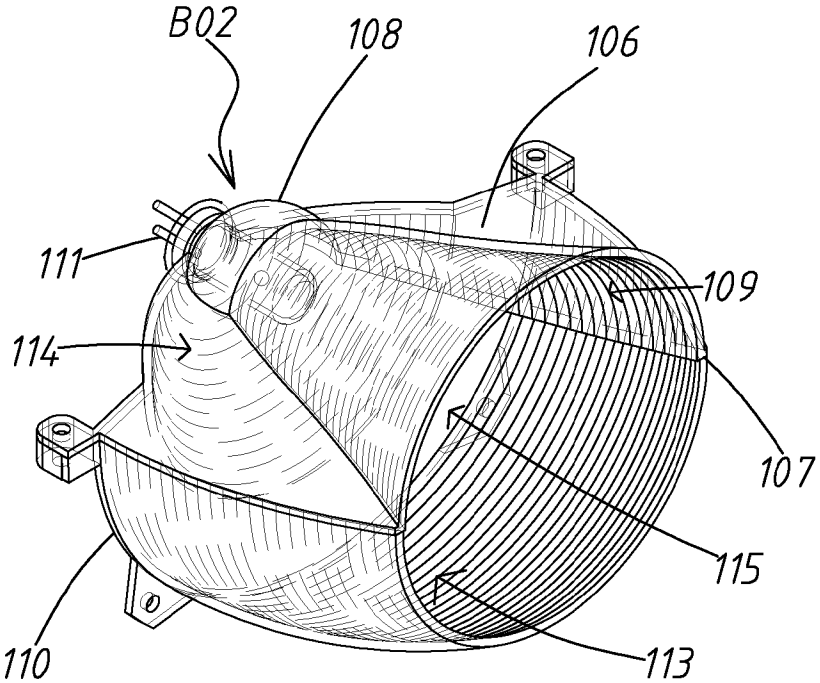
FIG. 1B Prior Art
FIGS. 1A and 1B depict two conventional reflecting structures and light sources.
Figure 1A:
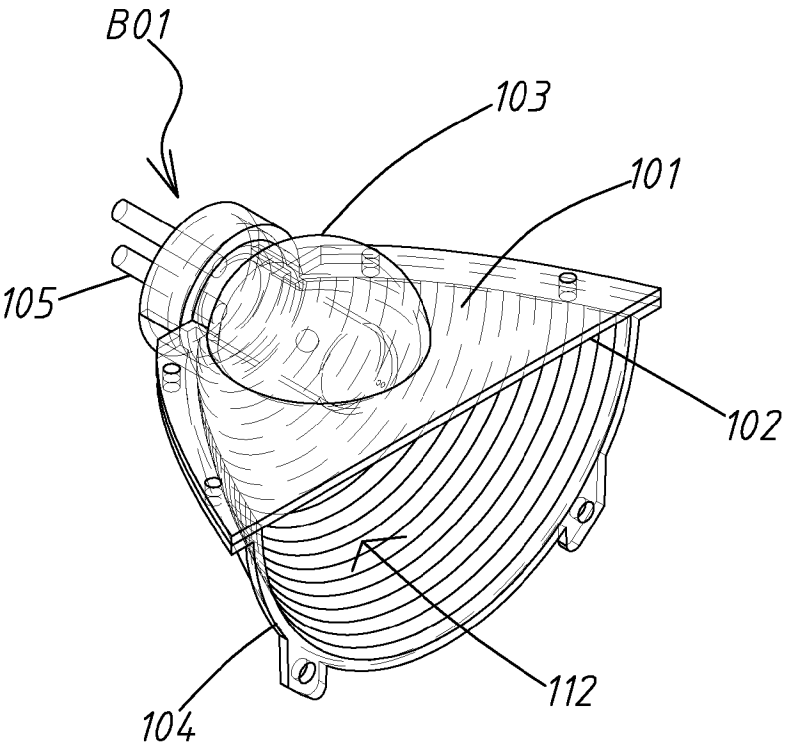
FIG. 1A Prior Art
Figure 2B:
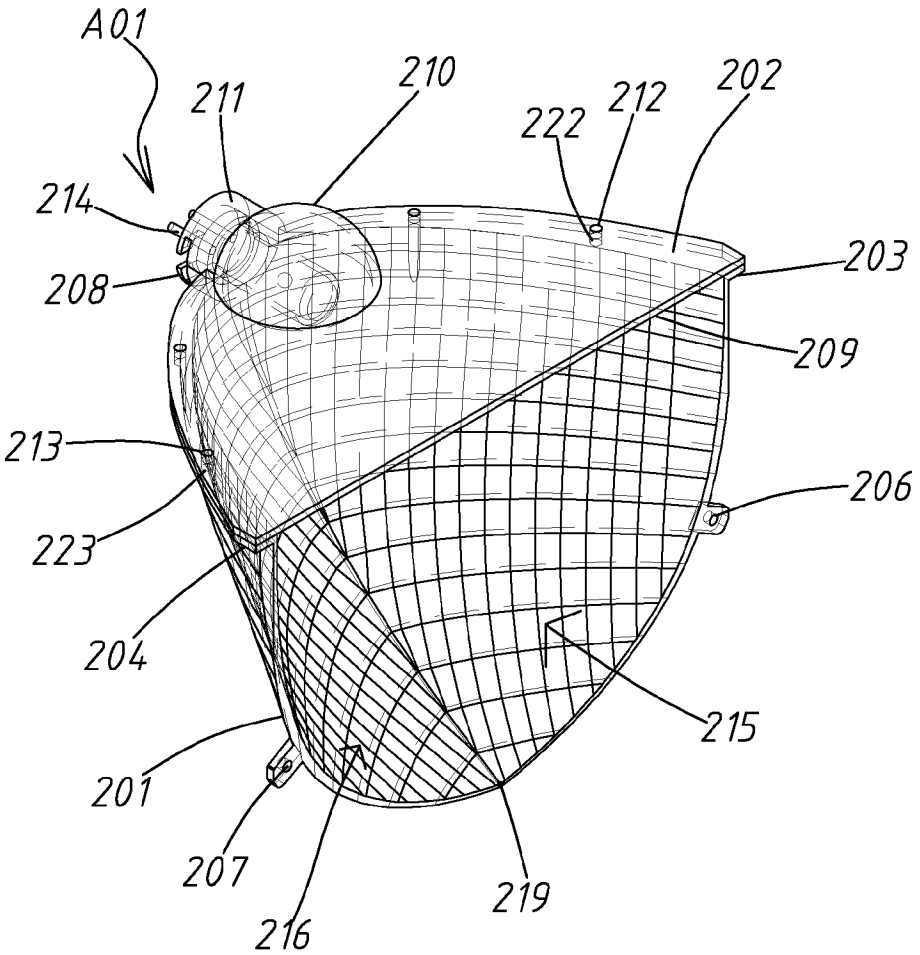
FIGS. 2A and 2B depict an embodiment of a reflecting structure of the invention.
Figure 2A:
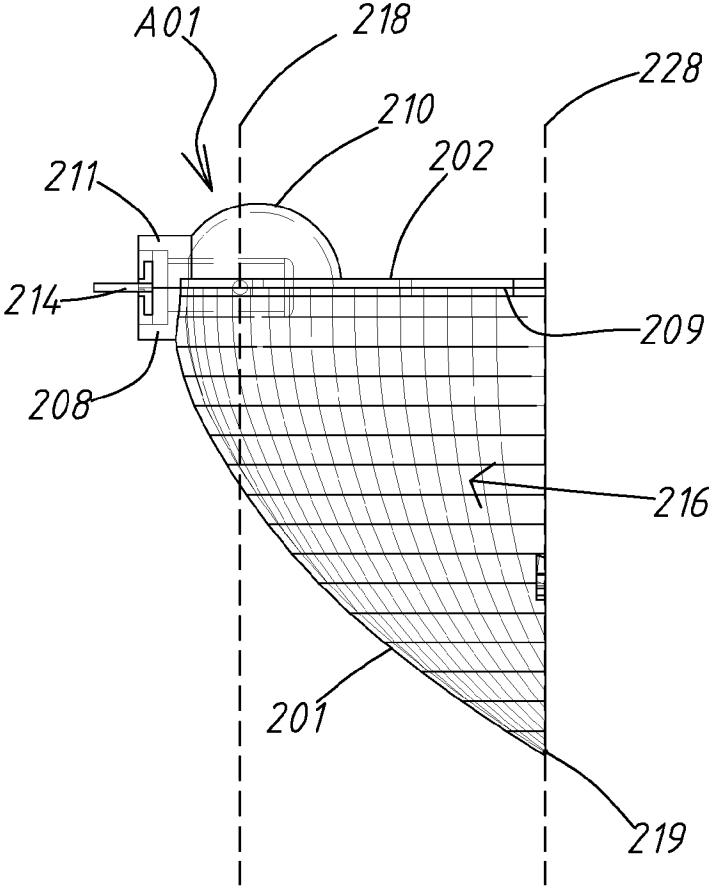
Figure 2C:
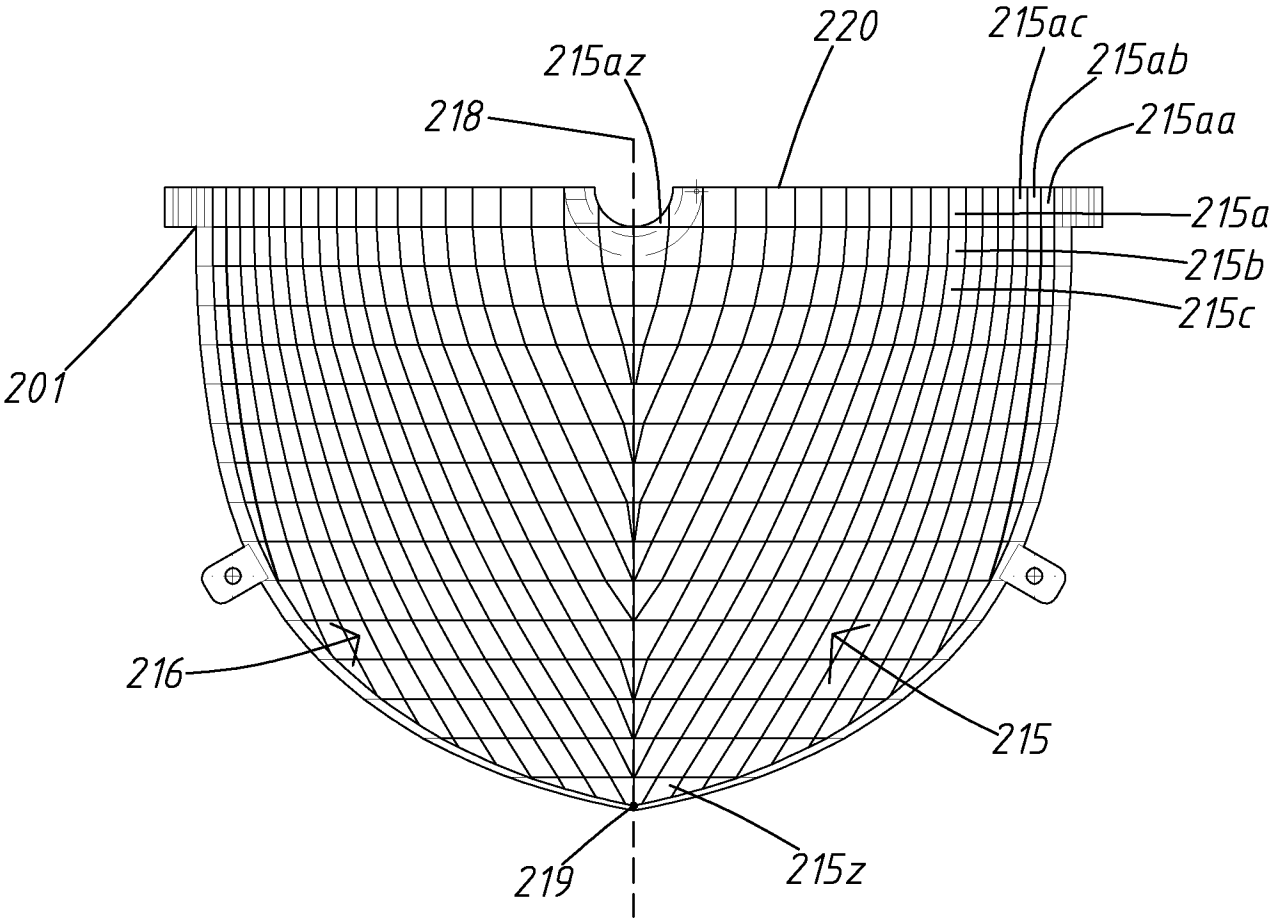
FIG. 2C depicts an inner surface of a main body of the embodiment shown in FIGS. 2A and 2B.

Referring to FIGS. 2A, 2B and 2C, a reflector A01 has an inner surface serving as a reflecting surface. The reflector A01 includes a main body 201 and a light intercepting plate 202. A light source 214 which can be a bulb, a light tube or LED is disposed in the reflector A01. The light intercepting plate 202 includes a light intercepting surface 209 intercepting light from the light source 214. In this embodiment, the light intercepting surface 209 is an inner surface of the light intercepting plate 202 and is a horizontal plane. The light intercepting plate 202 further includes an arced surface 210 extending from the light intercepting surface 209 and perpendicularly toward an outer surface of the light intercepting plate 202 (above the light intercepting surface 209). The arced surface 210 reflects light from the light source 214 toward an interior of the light intercepting plate 202. A positioning element 211 having a through hole is disposed on one lateral side of the arced surface 210 for mounting the light source 214. The light intercepting plate 202 includes two positioning elements 212 and 213 for joining to the main body 201. In this embodiment, the positioning elements 212 and 213 are through holes, but in other embodiments, the positioning elements can be grooves or ribs. The main body 201 is joined to the light intercepting surface 209 and includes a positioning element 208 and two extending planes 203 and 204. The positioning elements 208 and 211 hold and secure the light source 214. The extending planes 203 and 204 have positioning elements 222 and 223 to join the light intercepting plate 202. In this embodiment, the positioning elements 222 and 223 are through holes, but in other embodiments, the positioning elements can be grooves or ribs. Two positioning elements 206 and 207 are disposed on an outer surface of the main body 201 for joining to other elements (not shown). In this embodiment, the light source 214 is a light tube transversely disposed under the arced surface 210, but in other embodiments, a positioning element can be disposed on the top of the arced surface 210 for vertically mounting the light source 214 or inclined mounting the light source 214. Referring to FIG. 2C, the main body 201 includes two convex curved surfaces 215 and 216 disposed on two opposite sides of a vertical line 218 extending through the light source 214. The convex curved surface 215 includes a plurality of curved surface 215*a*, 215*b*, 215*c*, . . . , 215*z*. Each of the curved surfaces is disposed horizontally and includes a plurality of inclined surfaces or curved reflecting surfaces connected to each other. The curved surface 215*a*, which is the curved surface in the most top position of the convex curved surface 215, includes a plurality of reflecting surfaces 215*aa*, 215*ab*, 215*ac*, . . . , 215*az* connected to each other and curved toward a central line of the reflector 201 from a bottom of the reflector (the reflecting surface 215*aa*). The curved surfaces 215*a*, 215*b*, 215*c*, . . . , 215*z* are gradually inclined toward a base point 219 from the curved surface 215*a* disposed in the most top position to the curved surface 215*z* in the most bottom position. The base point 219 is formed by a vertical line 228 (shown in FIG. 2A) parallel to a vertical central line 218 of the light source 214 intersecting a lower edge of the reflector 201. The inclined angle and a length of the curved surfaces are gradually decreased from the curved surface 215*a* disposed in the most top position to a curved surface 215*z* in the most bottom position. In this embodiment, the convex curved surfaces 215 and 216 are symmetrical, but in other embodiments, the convex curved surfaces 215 and 216 can be non-symmetrical. The convex curved surface 216 has a structure the same as the convex curved surface 215.

Figure 3B:
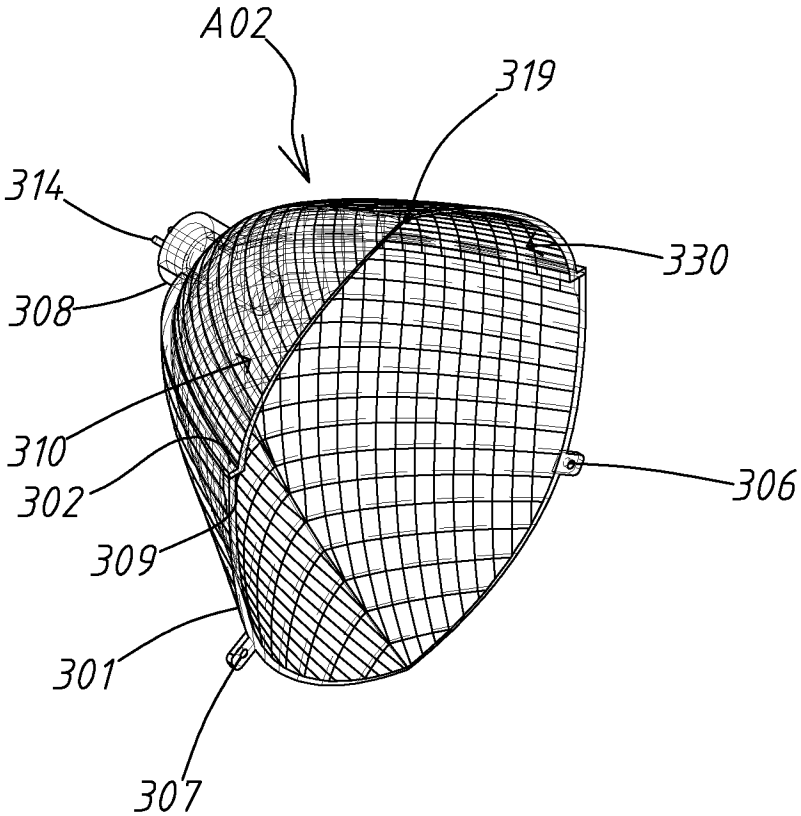
FIGS. 3A and 3B depict another embodiment of a reflecting structure of the invention.
Figure 3A:
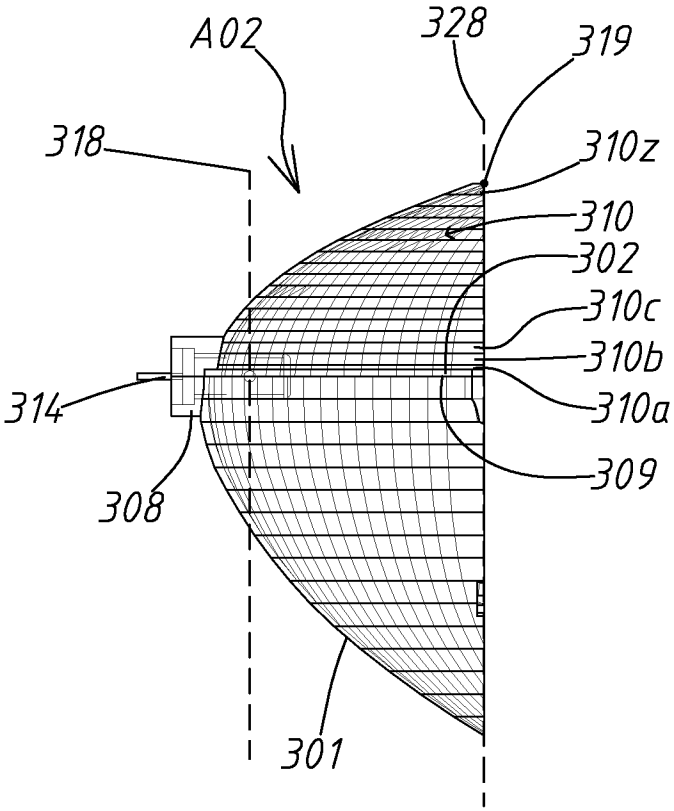

Referring to FIG. 3A and 3B, a reflector A02 includes a main body 301 and a light intercepting plate 302. In this embodiment, the main body 301 and the light intercepting plate 302 are integrally formed, but in other embodiments, the main body 301 and the light intercepting plate 302 can be individual parts. The reflector A02 has a positioning element 308 disposed atop for mounting a light source 314. The light intercepting plate 302 includes an inner surface serving as a light intercepting surface 309 which is a horizontally disposed plane. Two convex curved surfaces 310 and 330 are disposed on two opposite sides of a vertical central line 318 to reflect light from the light source 314 outwards. In this embodiment, the convex curved surfaces 210 and 330 are symmetrical, but in other embodiments, the convex curved surfaces can be non-symmetrical. Each of the convex curved surfaces 310 and 330 includes a plurality of curved surface. Each of the curved surfaces has an inclined angle different from the inclined angle of other curved surfaces. The convex curved surface 310 includes a plurality of curved surfaces 310*a*, 310*b*, 310*c*, . . . , 310*z* connected to each other. Each of the curved surfaces 310*a*, 310*b*, 310*c*, . . . , 310*z* is disposed horizontally and includes a plurality of inclined surfaces or curved reflecting surfaces connected to each other. Each of reflecting surfaces is curved toward a central line of the reflector 301 from a bottom of the reflector 301. The curved surfaces 215*a*, 215*b*, 215*c*, . . . , 215*z* are gradually inclined toward a base point 319 from the curved surface 310*a* (on the light intercepting surface 309) disposed in the most bottom position to the curved surface 310*z* in the most top position. The base point 319 is formed by a vertical line 328 parallel to a vertical central line 318 of the light source 314 intersecting a lower edge of the reflector 301. The inclined angle and a length of the curved surfaces are gradually decreased from the curved surface 310*a* disposed in the most bottom position to a curved surface 310*z* in the most top position. The convex curved surface 330 has a structure the same as the convex curved surface 310. The main body 301 is joined to the light intercepting surface 309 of the light intercepting plate 302. The assembly structure is the same as the main body 201 of FIG. 2. Two positioning elements 306 and 307 are disposed on an outer surface of the main body 301 for joining other devices (not shown). In this embodiment, the light source 314 is a light tube transversely disposed at the top of the reflector A02.

Figure 4B:
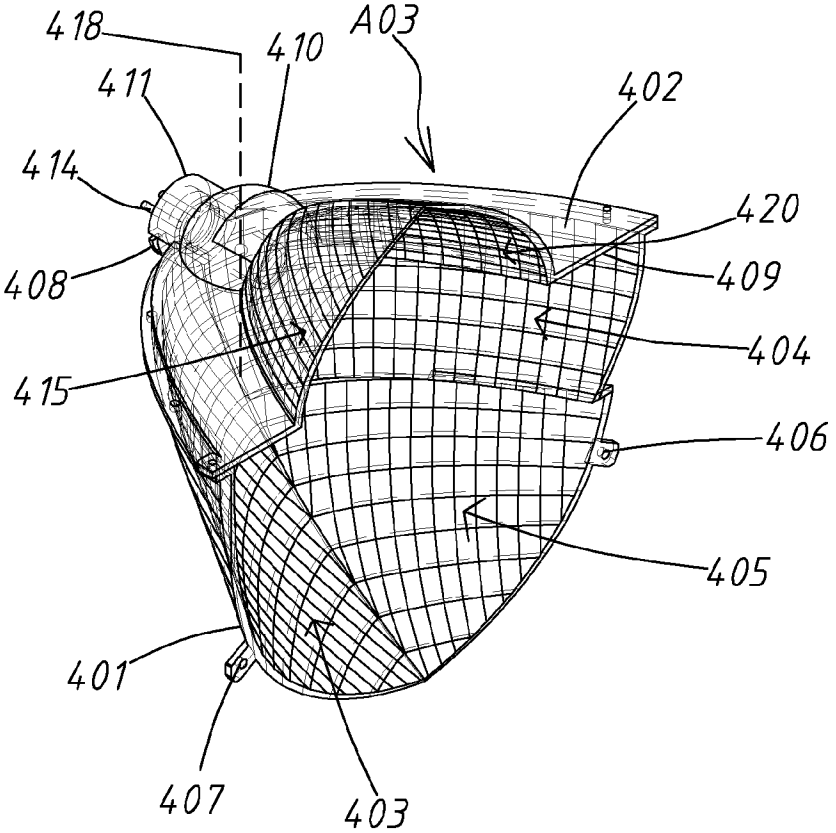
FIGS. 4A and 4B depict another embodiment of a reflecting structure of the invention.
Figure 4A:
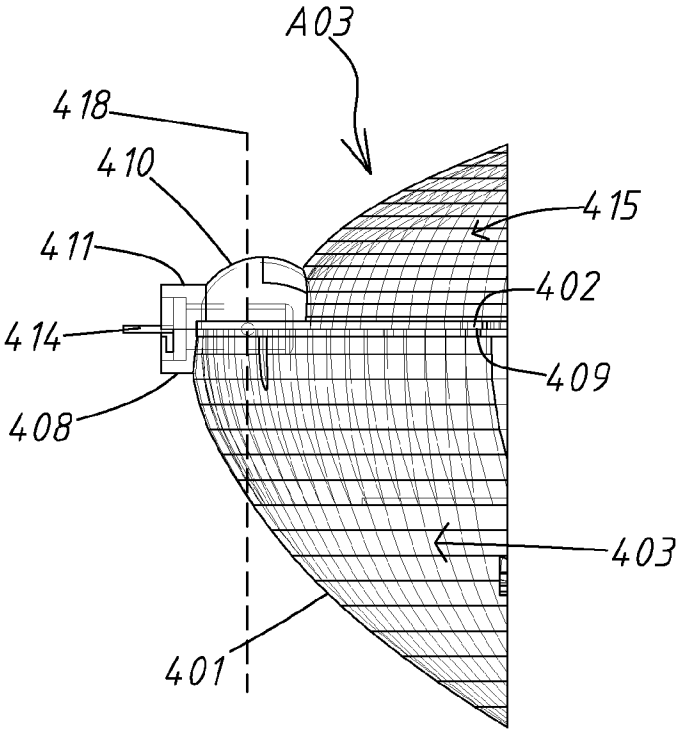

Referring to FIGS. 4A and 4B, a reflector A03 includes a main body 401 and a light intercepting plate 402. In this embodiment, the main body 401 and the light intercepting plate 402 are integrally formed, but in other embodiments, the main body 401 and the light intercepting plate 402 can be individual parts. The light intercepting plate 402 has in inner surface serving as a light intercepting surface 409. An arced surface 410 extend upward from the light intercepting surface 409 to reflect light from a light source 414 to an interior of the light intercepting plate 402. Two convex curved surfaces 415 and 420 also extends upwards from the light intercepting surface 409 and are disposed in front of the arced surface 410. A positioning element 411 is disposed on one lateral side of the arced surface 410 for mounting the light source 414. The convex curved surfaces 415 and 420 have structures the same as the convex curved surfaces 310 and 330 of FIG. 3. The main body 401 is joined to the light intercepting surface 409 and includes three convex curved surfaces 403, 404 and 405. The convex curved surfaces 04 and 405 are disposed on one side of a vertical central line 418 extending through the light source 414 and in an upper position and a lower position respectively. The convex curved surface 403 is disposed on the other side of the vertical central line 418. Each of the convex curved surfaces 403, 404 and 405 has a structure the same as the convex curved surfaces 215 and 216 of the main body 201 of FIG. 2. A positioning element 408 having a through hole disposed on an outer surface of the main body 401 and a positioning element 411 extending from the arced surface 410 hold and secure the light source 414. Two positioning elements 406 and 407 are disposed on an outer surface of the main body 401 for joining to other devices (not shown). The light source 414 is a light tube transversely disposed in a top position of the reflector A03.

Figure 5B:
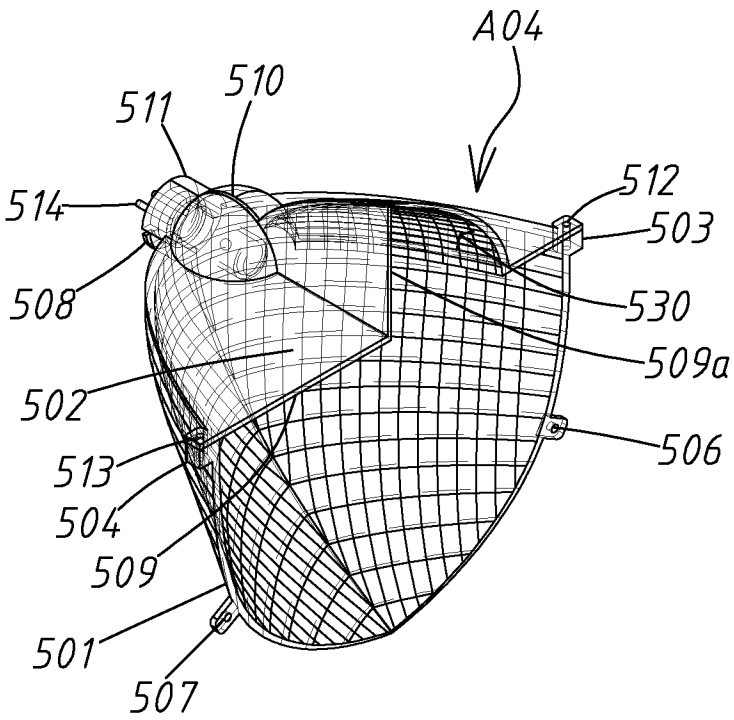
FIGS. 5A and 5B depict another embodiment of a reflecting structure of the invention.
Figure 5A:
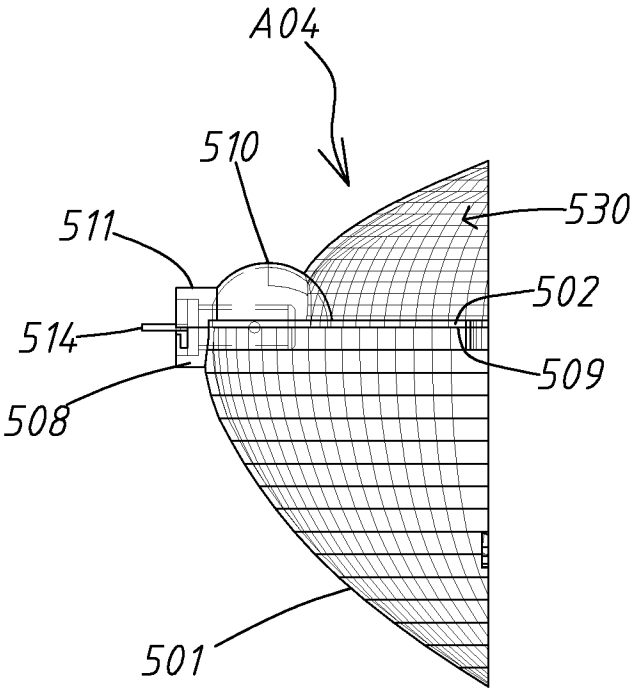

Referring to FIGS. 5A and 5B, a reflector A04 includes a main body 501 and a light intercepting plate 502. The light intercepting plate 502 has an inner surface serving as a light intercepting surface 509. An arced surface 510 extending from the light intercepting surface 509 reflects light from a light source 514 toward inner side of the light intercepting surface 509. A vertical light intercepting plane 509*a* is disposed in front of the arced surface 510. A convex curved surface 530 is disposed on the light intercepting surface 509 and connected to the arced surface 510. The vertical light intercepting plane 509*a* is disposed in front of the light source 514 and extends through a plurality of vertical lines parallel to a vertical line extending through the light source 514. The convex curved surface 530 reflects light outwards. A positioning element 511 is disposed on one lateral side of the arced surface 510 for mounting the light source 514. The convex curved surface 530 has a structure the same as the convex curved surface as shown in FIG. 3. The light intercepting plate 502 includes two positioning elements 512 and 513. The main body 501 is joined to the light intercepting surface 509. The main body 501 has a structure the same as the main body 201 shown in FIG. 2. A positioning element 508 disposed on a top of the main body 501 and the positioning element 511 of the arced surface 510 hold the light source 514. Two planes 503 and 504 extend from an upper edge of the main body 501, and each of the planes 503 and 504 has a positioning element for joining the light intercepting plate 502. Two positioning elements are disposed on an outer surface of the main body 501 for joining other devices (not shown). In this embodiment, the light source 514 is a light tube transversely disposed on the top of the reflector A04.

Figure 6C:
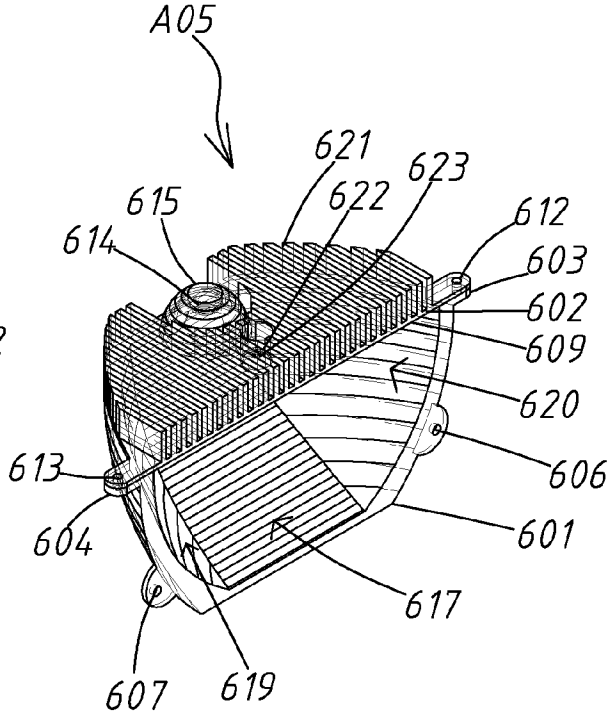
FIGS. 6A to 6C depict another embodiment of a reflecting structure of the invention.
Figure 6B:
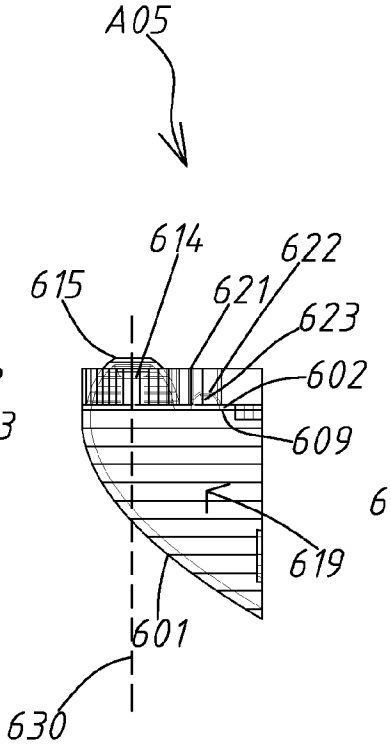
Figure 6A:
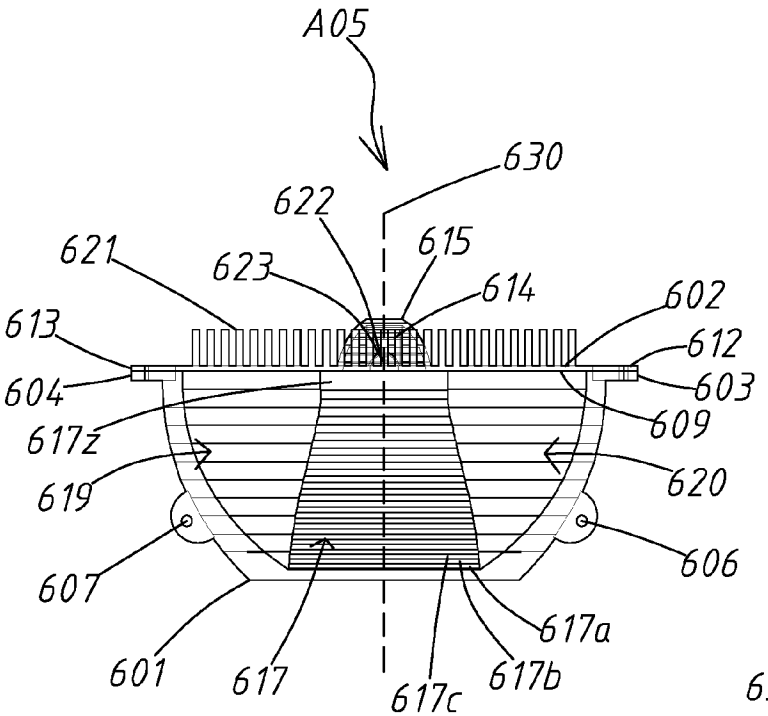

Referring to FIGS. 6A, 6B and 6C, a reflector A05 includes a main body 601 and a light intercepting plate 602. The light intercepting plate 602 has an inner surface which is a horizontal plane serves as a light intercepting surface 609. A conical reflecting surface 615 extends upwards from the light intercepting surface 609. A light emitting diode 614 is disposed on a top of the conical reflecting surface 615. Another conical reflecting surface 622 on the light intercepting surface 615 and in front of the conical reflecting surface 615. Another light emitting diode 623 is disposed on a top of the conical reflecting surface 622. The light emitting diode 623 is used for daytime running light or warning light. Another light source can be disposed on the main body or the light intercepting plate in the embodiments of the reflecting structures of the invention. The light intercepting plate 602 includes two positioning elements 612 and 613, and a plurality of fins 612 is disposed on an outer surface of the light intercepting plate 602 for heat dissipation of the light source 614. The main body 601 is joined to the light intercepting surface 609 and includes a stripped reflecting surface 617 and two convex curved surfaces 619 and 620. The stripped reflecting surface 617 connects the convex curved surfaces 619 and 620. A vertical central line 630 of the light source 614 extends through the stripped reflecting surface 617. The stripped reflecting surface 617 includes a plurality of inclined surfaces 617*a*, 617*b*, 617*c*, . . . , 617*z* connected to each other. Each of the inclined surfaces 617*a*, 617*b*, 617*c*, . . . , 617*z* has an inclined angle, and the inclined angle of the inclined surfaces is gradually increased from a bottom of the reflector A05 (the inclined surface 617*a*) to a top of the reflector A05 (the inclined surface 617*z*). The length of the inclined surfaces is gradually decreased from the bottom to the top of the reflector A05. In other embodiments, the length of the inclined surfaces can be equal. The convex curved surfaces 619 and 620 have structures the same as the convex curved surface 215 and 216. Two planes 603 and 604 extends from two lateral sides of the main body 601, and each of the planes 603 and 604 has a positioning elements for mounting the light intercepting plate 602. Two positioning elements 606 and 607 having through holes are disposed on an outer surface of the main body 601. In other embodiments, a plurality of fins are disposed on the outer surface of the main body 601 for heat dissipation.

Figure 7B:
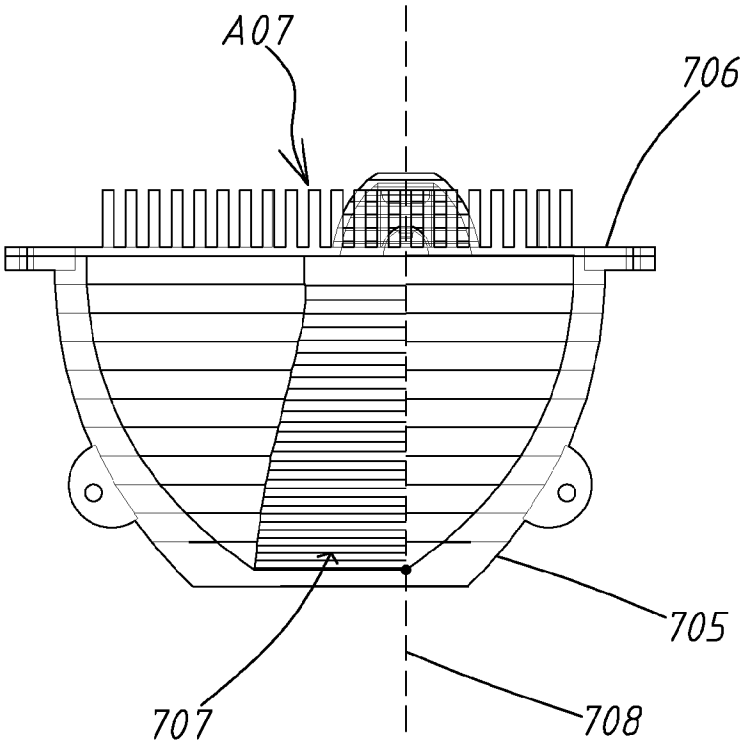
FIGS. 7A and 7B depict other two embodiments of a reflecting structure of the invention.
Figure 7A:
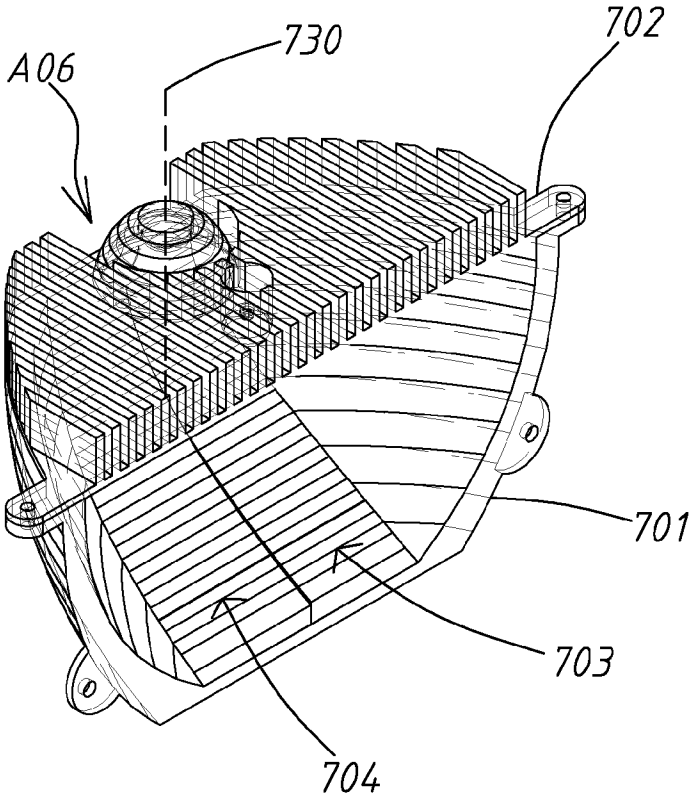

Referring to FIG. 7A, a reflector A06 includes a main body 701 and a light intercepting plate 702 and has a structure similar to the reflector A05 of FIGS. 6A-6C. However, the main body 701 includes two stripped reflecting surfaces 703 and 704 disposed on two side of a vertical central line 730. Referring to FIG. 7B, a reflector A07 includes a main body 705 and a light intercepting plate 706 and has a structure similar to the reflector A05 of FIGS. 6A-6C. However, the main body 701 includes a stripped reflecting surface 707 disposed on one side of a vertical central line 708.

Figure 8B:
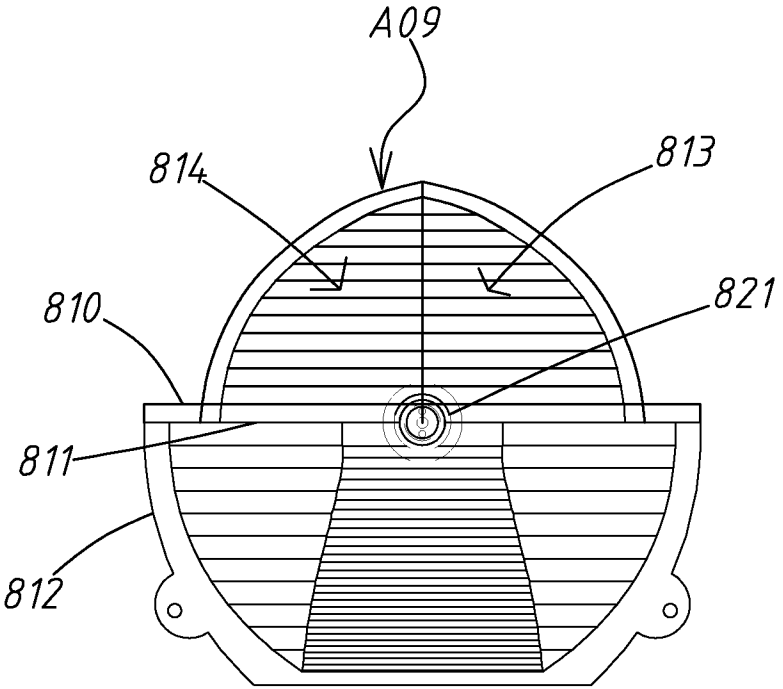
FIGS. 8A and 8B depict other two embodiments of a reflecting structure of the invention.
Figure 8A:
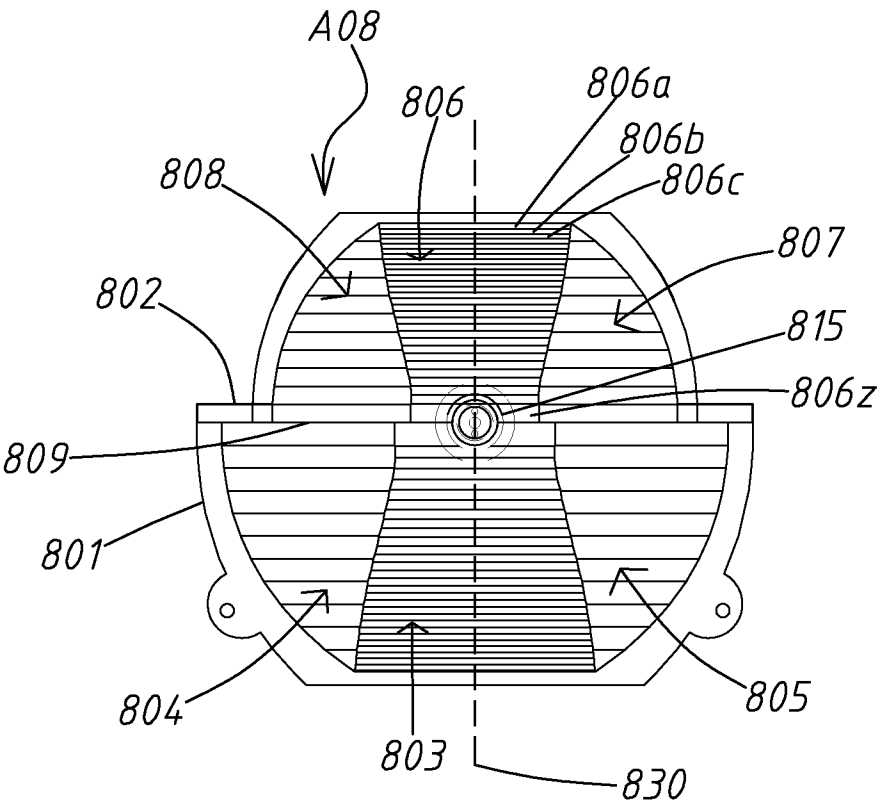

Referring to FIG. 8A, a reflector A08 includes a main body 801 and a light intercepting plate 802. In this embodiment, the main body 801 and the light intercepting plate 802 are integrally formed, but in other embodiments, the main body 801 and the light intercepting plate 802 can be individual parts. The light intercepting plate 802 has in inner surface serving as a light intercepting surface 809. Two convex curved surfaces 807 and 808 and a stripped reflecting surface 806 connecting the convex curved surfaces 807 and 808. The stripped reflecting surface 806 includes a plurality of inclined surfaces 806*a*, 806*b*, 806*c*, . . . , 806*z* connected to each other. Each of the inclined surfaces 806*a*, 806*b*, 806*c*, . . . , 806*z* has an inclined angle, and the inclined angle of the inclined surfaces is gradually increased from a bottom of the reflector A08 (the inclined surface 806*a*) to a top of the reflector A08 (the inclined surface 608*z*). The length of the inclined surfaces 806*a*, 806*b*, 806*c*, . . . , 806*z* is gradually decreased from the bottom to the top of the reflector A08. In other embodiments, the length of the inclined surfaces can be equal. In this embodiment, the stripped reflecting surface 806 is disposed on two sides of a vertical central line 830, in other embodiments, the stripped reflecting surface 806 can be disposed on one side of the vertical central line 830 as the stripped reflecting surface 707 of FIG. 7B, and further in other embodiments, two inclined stripped reflecting surfaces are disposed on two sides of the. The main body 801 includes a stripped reflecting surface 803 and two convex curved surfaces 804 and 805. The stripped reflecting surface 803 connects the convex curved surfaces 804 and 805, which is similar to the main body 601 as shown in FIG. 6. A positioning element 815 having a through hole is disposed on a top of the reflector A08 for mounting a light source. Referring to FIG. 8B, a reflector A09 includes a main body 812 and a light intercepting plate 810. The main body 812 and the light intercepting plate 810 are integrally formed, but in other embodiments, the main body 810 and the light intercepting plate 812 can be individual parts. The light intercepting plate 812 has in inner surface serving as a light intercepting surface 811. Two convex curved surfaces 813 and 814 extending upwards from the light intercepting surface 811 have structures similar to the convex curved surfaces 310 and 330 of FIG. 3. The main body 812 has a structure similar to the main body 601 shown in FIG. 6. The reflector A09 has a positioning element 821 having a through hole for mounting a light source.

Figure 9B:
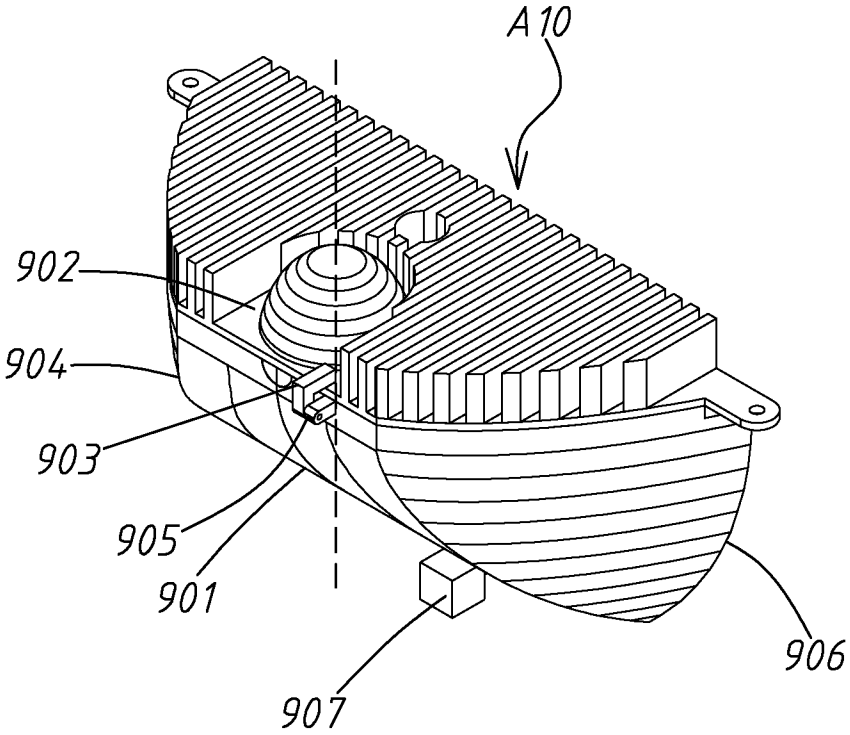
FIGS. 9A and 9B depict another embodiment of a reflecting structure of the invention.
Figure 9A:
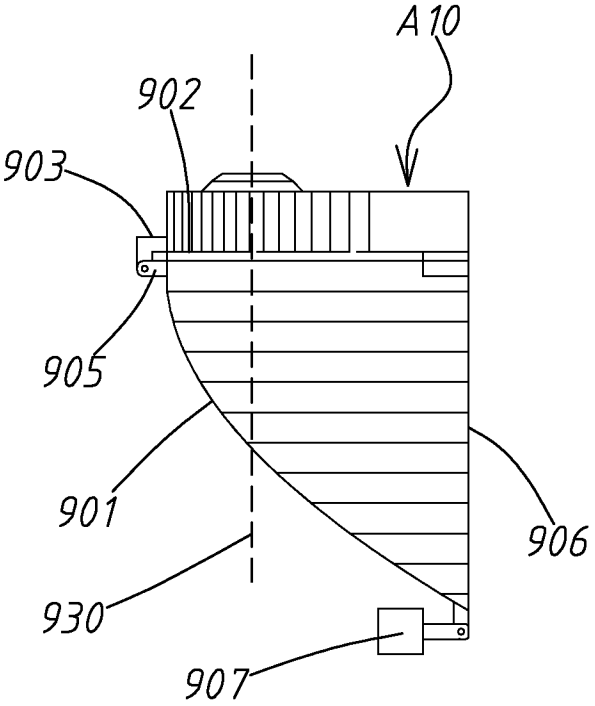

Referring to FIG. 9, a reflector A10 includes a light intercepting plate 902 and a main body 901. The reflector A10 has a structure similar to the structure of the reflector A05 of FIG. 6. However, in this embodiment, the light intercepting plate 902 includes a L-shaped positioning element 903. The main body 901 includes two individual convex curved surfaces 904 and 906. The convex curved surface 904 is tightly joined to the light intercepting plate 902, and the convex curved surface 906 includes at least one positioning element 905 and movably disposed the positioning element 903 of the light intercepting plate 902. An electromagnetic device 907 is connected to the convex curved surface 906 and regulates an elevation angle of the convex curved surface 906. Therefore, a lamp using the reflector A10 can switch between high beam and low beam through the regulation.

Figures 10A, 10B, 10C:
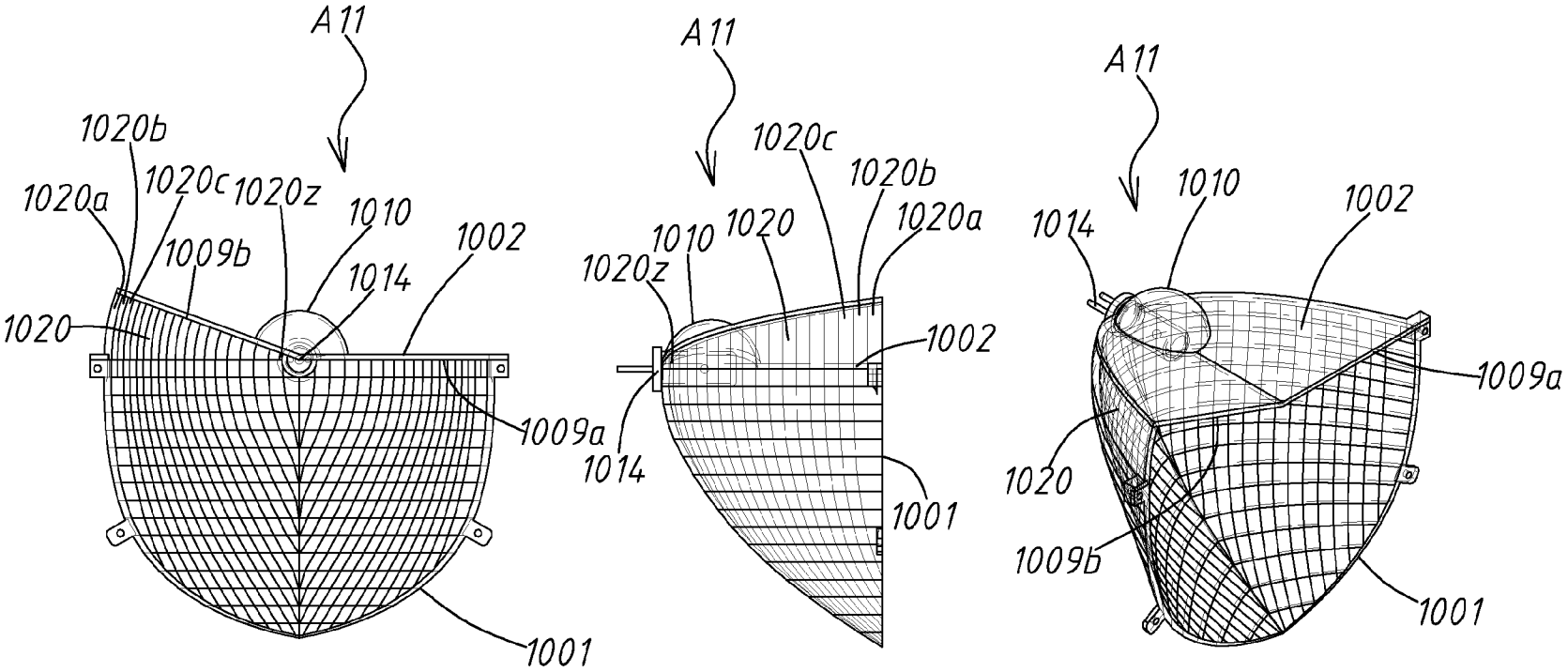
FIGS. 10A to 10C depict another embodiment of a reflecting structure of the invention.

Referring to FIGS. 10 A to 10C, a reflector A11 includes a light intercepting plate 1002 and a main body 1001. The main body 1001 has a structure similar to the main body 201 of FIGS. 2A, 2B and 2C. The light intercepting plate 1002 has an inner surface including a horizontal light intercepting surface 1009*a*, an inclined light intercepting surface 1009*b* and an arced reflecting surface 1010 extend upwards from the horizontal light intercepting surface 1009*a* and the inclined light intercepting surface 1009*b*. A conical curved reflecting surface 1020 extends downwards from an outer edge of the inclined light intercepting surface 1009*b*. The conical curved reflecting surface 1020 includes a plurality of arced inclined surface 1020*a*, 1020*b*, 1020*c*, . . . , 1020*z* connected to each other. Each of the arced inclined surface 1020*a*, 1020*b*, 1020*c*, . . . , 1020*z* has an inclined angle gradually increased from a bottom of the reflector A11 (the arced inclined surface 1020*z*) to a top of the reflector A11 (the arced inclined surface 1020*a*). The conical curved reflecting surface 1020 reflects light outwards from the reflector A11. A light source 1014 is disposed on a top of the reflector A11.

Figure 11C:
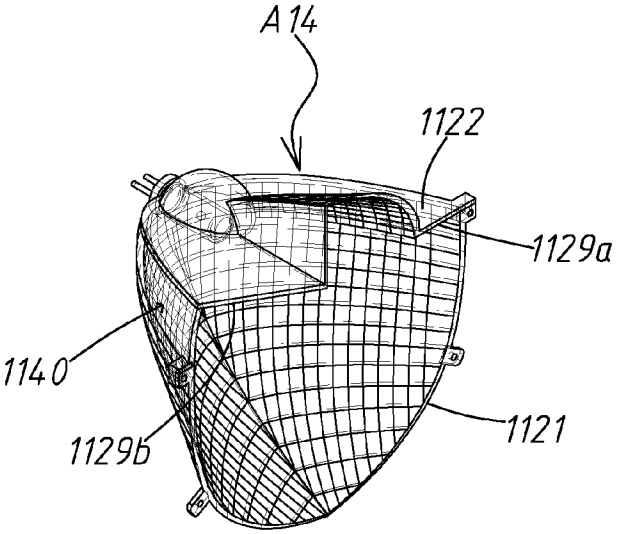
FIGS. 11A to 11C depict other three embodiments of a reflecting structure of the invention.
Figure 11B:
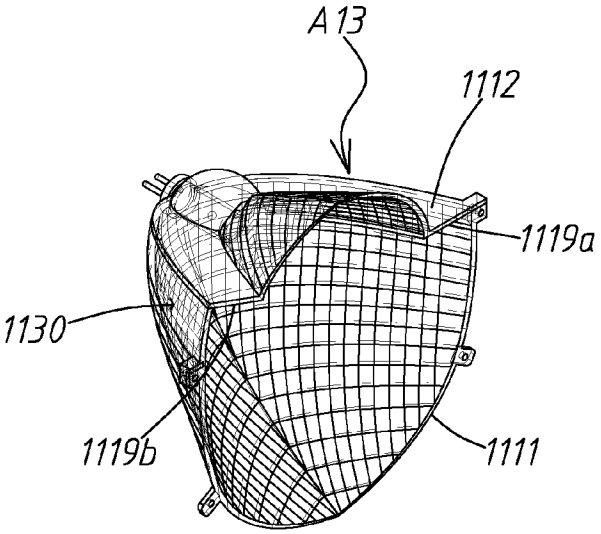
Figure 11A:
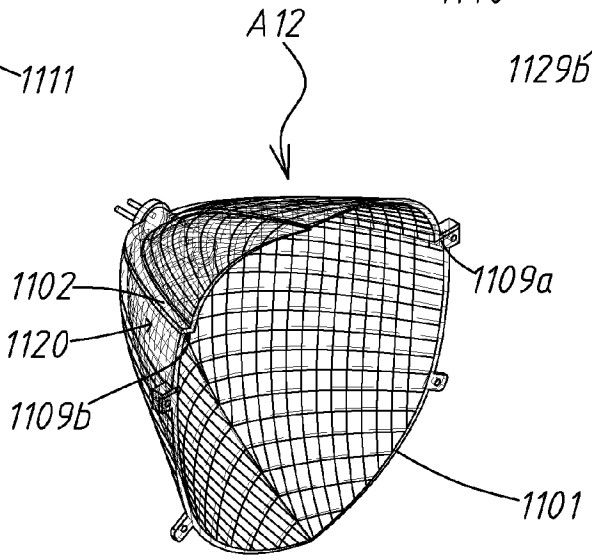

Referring to FIG. 11A, a reflector A12 includes a light intercepting plate 1102 and a main body 1101 and has a structure similar to the structure of the reflector A02 of FIGS. 3A and 3B. The reflector A12 however includes a horizontal light intercepting surface 1109*a*, an inclined light intercepting surface 1109*b* and a conical curved reflecting surface 1120 extending from an outer edge of the inclined light intercepting surface 1109*b*. The conical curved reflecting surface 1120 has a structure similar to the structure of the conical curved reflecting surface 1120 of FIG. 10A to 10C. Referring to FIG. 11B, a reflector A13 includes a light intercepting plate 1112 and a main body 1111 and has a structure similar to the structure of the reflector A03 of FIGS. 4A and 4B. The light intercepting plate 1112 includes a horizontal light intercepting surface 1119*a*, an inclined light intercepting surface 1119*b* and a conical curved reflecting surface 1130 extending from an outer edge of the inclined light intercepting surface 1119*b*. The conical curved reflecting surface 1130 has a structure similar to the conical curved reflecting surface 1020 of FIGS. 10A to 10C. Referring to FIGS. 11C, a reflector A14 includes a light intercepting plate 1122 and a main body 1121 and has a structure similar to the reflector A04 of FIGS. 5A and 5B. The light intercepting plate 1122 however includes a horizontal light intercepting surface 1129*a*, an inclined light intercepting surface 1129*b* and a conical curved reflecting surface 1140 extending from an outer edge of the inclined light intercepting surface 1129*b*. The conical curved reflecting surface 1140 has a structure similar to the conical curved reflecting surface 1020 of FIGS. 10A to 10C.

Figure 12B:
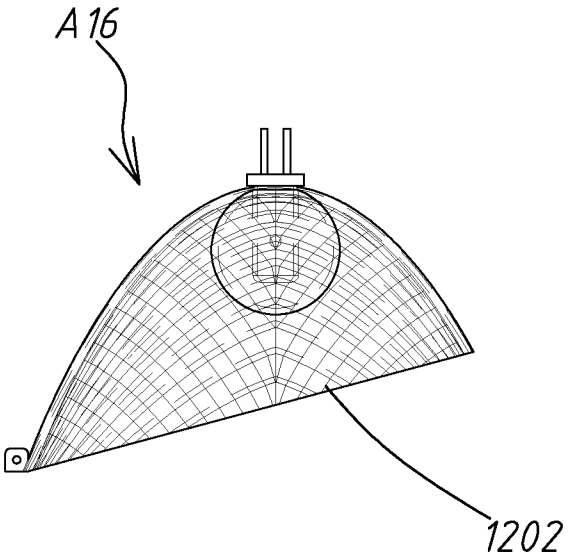
FIGS. 12A and 12B depict other two embodiments of a reflecting structure of the invention.
Figure 12A:
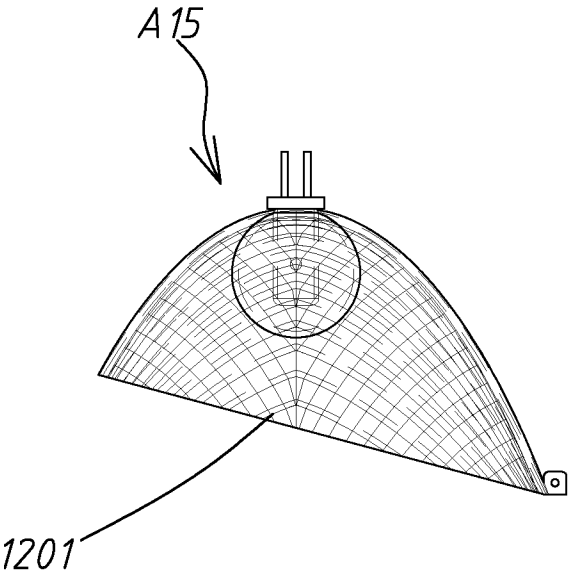

Referring to FIG. 12A, a reflector A15 has a bottom 1201 inclined from a left hand side to a right hand side. Referring to FIG. 12B, a reflector A16 has a bottom 1202 inclined from a right hand side to a left hand side. The reflectors A15 and A16 are symmetrical for their inclined bottoms 1201 and 1202, and can be applied to a vehicle and mounted to a streamline shaped panel. In it noted that each embodiment of the reflectors of the invention can have an inclined bottom for various panels of vehicles.

Figure 13:
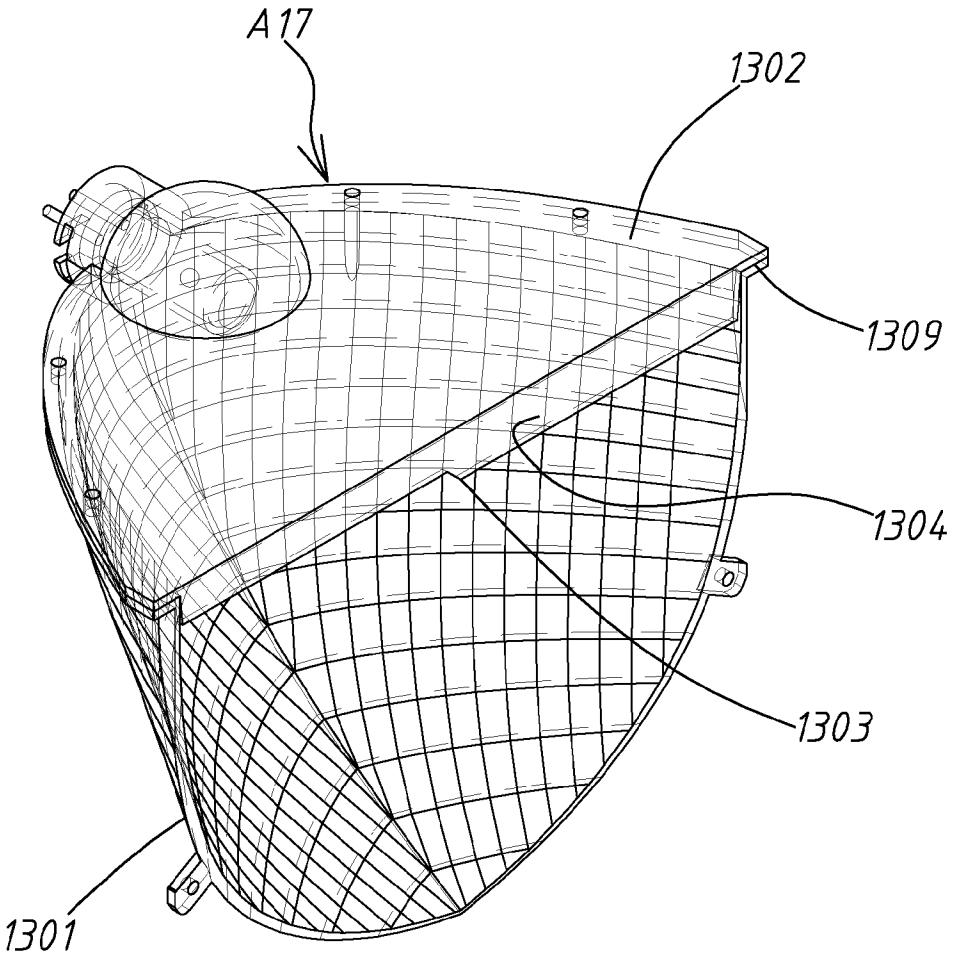
FIG. 13 depicts another embodiments of a reflecting structure of the invention.

Referring to FIG. 13, a reflector A17 includes a main body 1301 and a light intercepting plate 1302 and has a structure similar to the reflector A01 of FIG. 2A and 2B. The light intercepting plate 1302 of this embodiment includes a stepped wall 1303 perpendicular to an edge of the light intercepting plate 1302. The light intercepting plate 1302 has an inner surface serving as a light intercepting surface 1309, and the stepped wall 1303 has an inner surface serving as a second light intercepting surface 1304 perpendicular to the light intercepting surface 1309. The second light intercepting surface 1304 causes a stepped shape of illuminating region.

Figure 14:
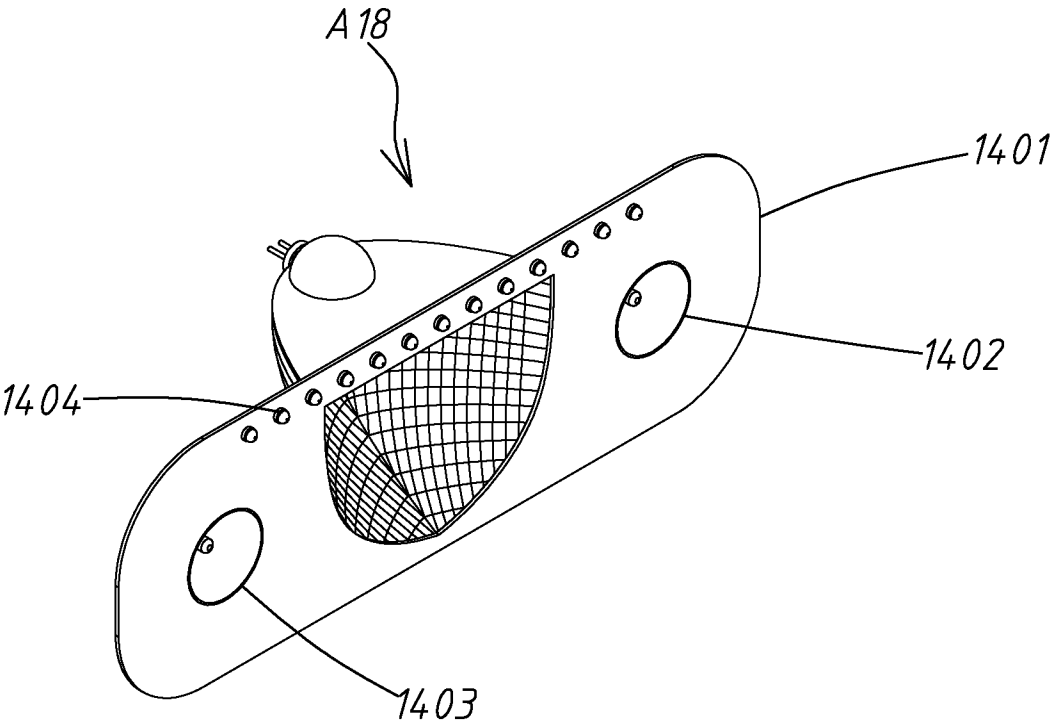
FIG. 14 depicts another embodiments of a reflecting structure of the invention.

Referring to FIG. 14, a panel for decoration extends from an outer edge of a reflector A18. A turning indicator 1402, a fog warning light 1403 and LED car wide light 1404 are disposed on the panel 1401. The reflector A18 has a structure similar to the reflector A01 of FIGS. 2A and 2B. The panel 1401 can also be added to all embodiments of the reflector of the invention.

Figure 15B:
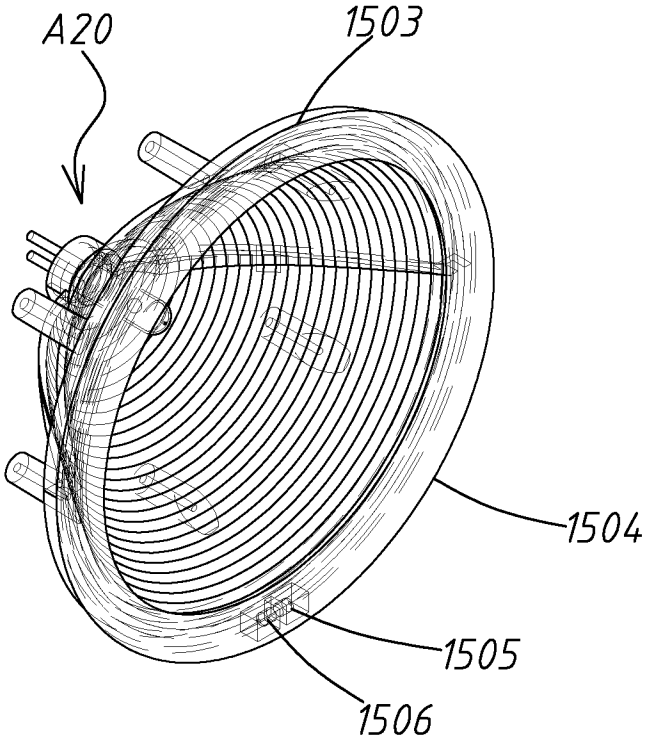
FIGS. 15A and 15B depict other two embodiments of a reflecting structure of the invention.
Figure 15A:
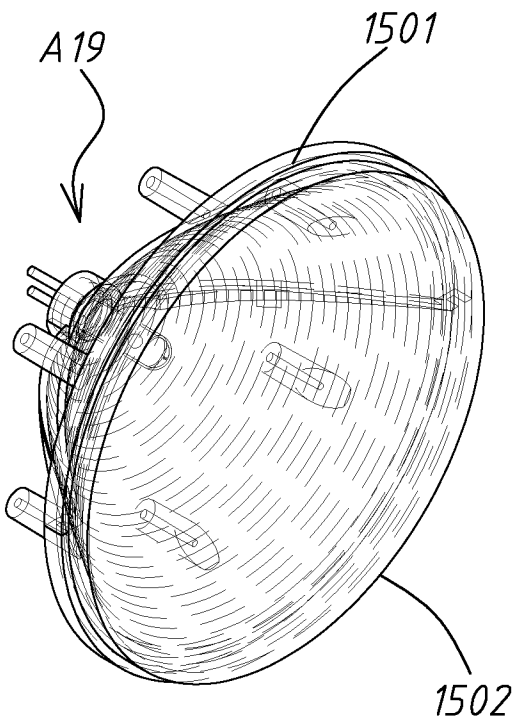

Referring to FIGS. 15A, a reflector A19 has a structure similar to the reflector A02 of FIGS. 3A and 3B. The reflector A19 has a bottom including a positioning element 1501 which is a groove for joining a transparent plate 1502. Referring to FIG. 15B, a reflector A20 has a structure similar to the reflector A02 of FIGS. 3A and 3B. The reflector A20 has a bottom including a positioning element 1503 which is a groove for joining a light emitting module 1504. The light emitting module 1504 includes LED light sources 1505 and 1506.

Figure 16B:
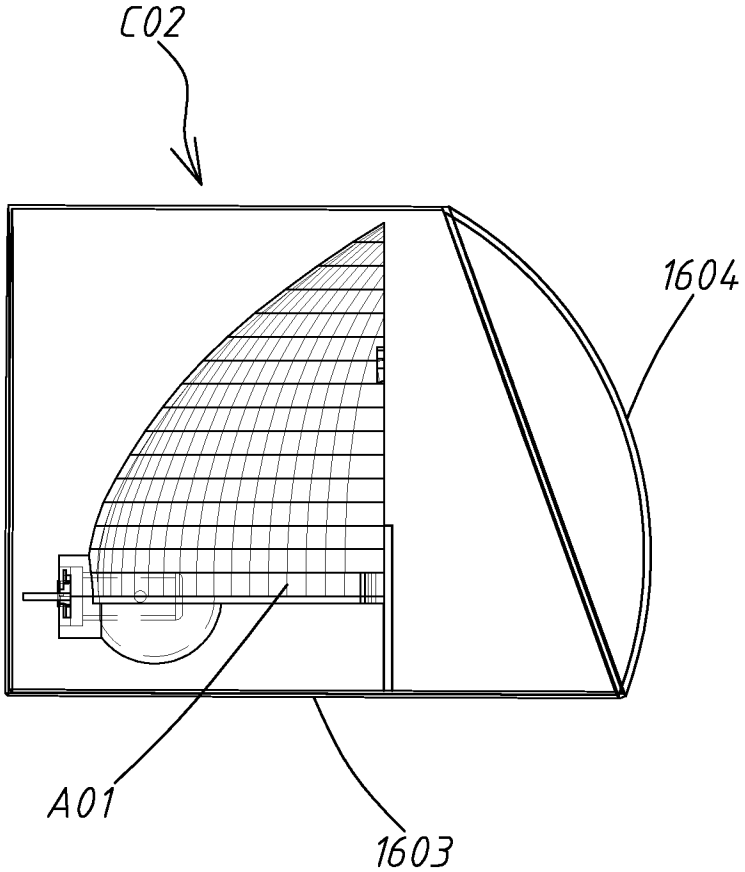
FIGS. 16A and 16B depict two embodiments of a reflecting structure of the invention applied to a lamp.
Figure 16A:
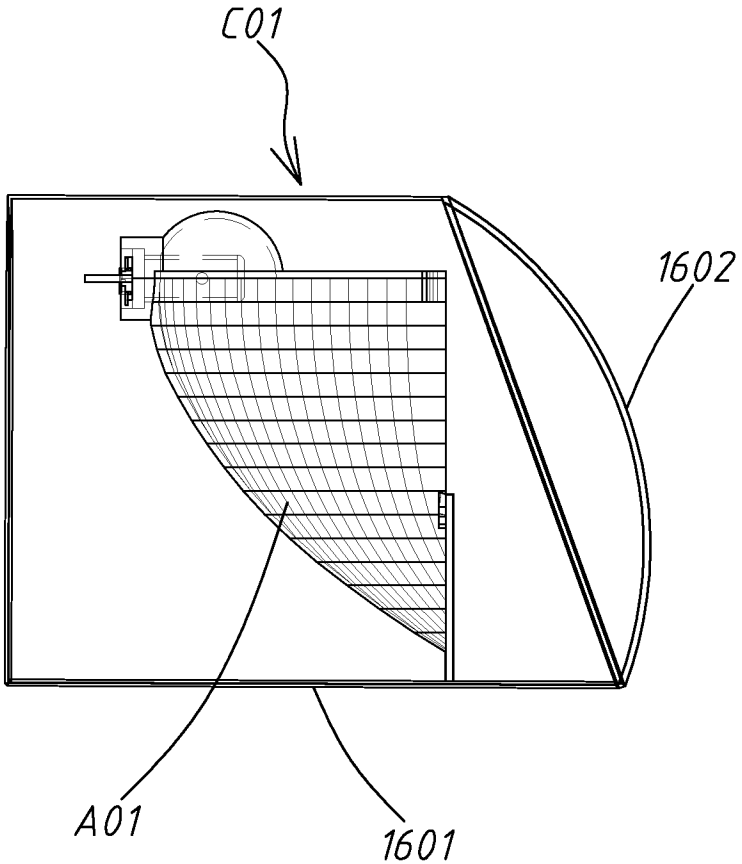

Referring to FIGS. 16A and 16B, a lamp C01 includes an anti-dust cover 1601. A transparent plate 1602 is disposed on one lateral side of the anti-dust cover 1601. The reflector A01 is disposed in the anti-dust cover 1601. A lamp C02 includes an anti-dust cover 1603, and a transparent plate 1604 is disposed on one lateral side of the anti-dust cover 1603. The reflector A01 is disposed upside down in the anti-dust cover 1603. The anti-dust covers 1601 and 1603 further include a through hole or movable closing structure for maintenance or replacement. An accessory for a light emitting module, a lens or a grating (not shown) can be disposed at the bottom of the reflector A01.

Figure 17:
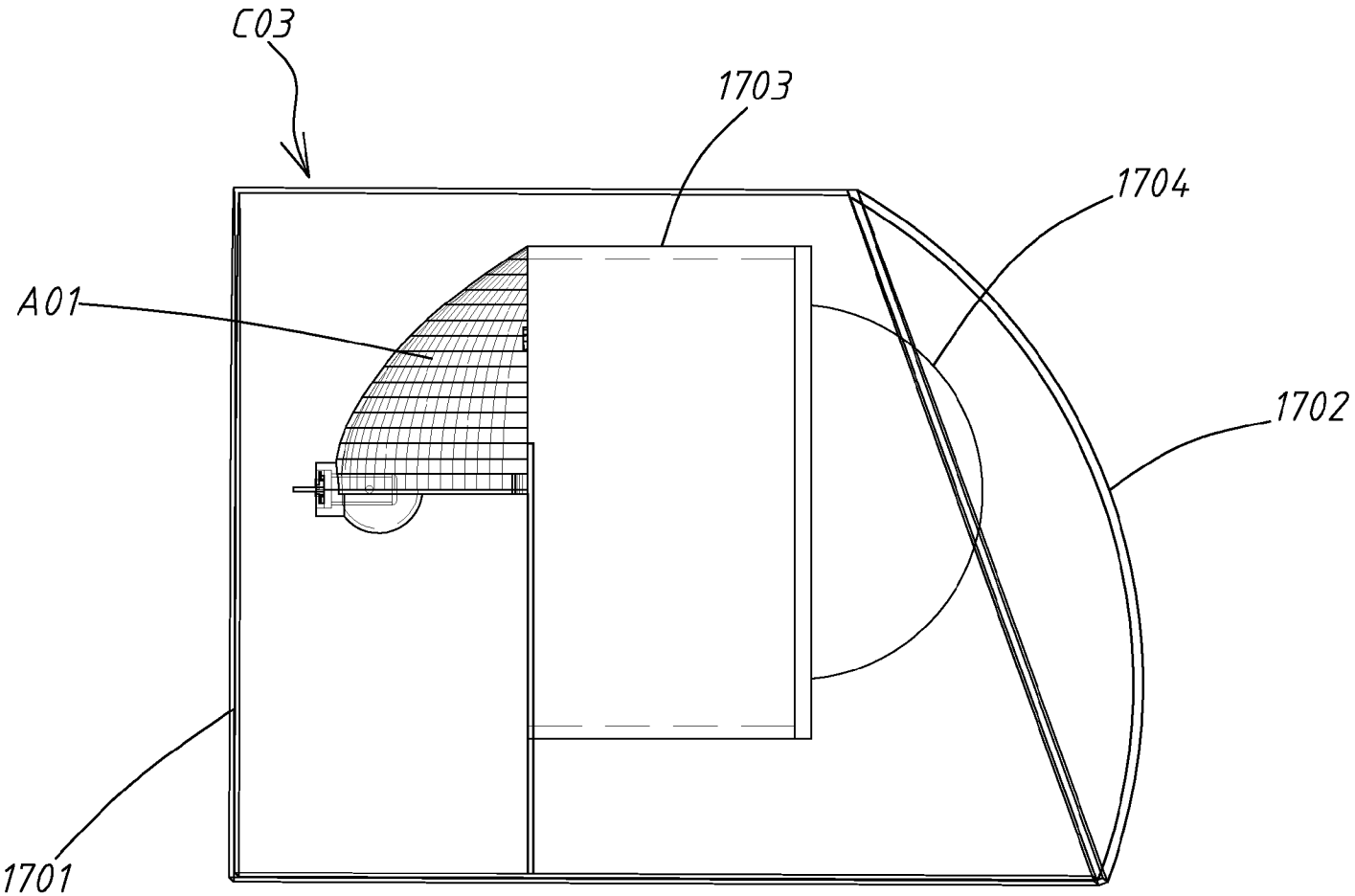
FIG. 17 depicts another embodiment of a reflecting structure of the invention applied to a lamp.

Referring FIG. 17, a lamp C03 includes an anti-dust cover 1701, and a transparent plate 1702 is disposed on a lateral side of the anti-dust cover 1701. A reflector A01 of the invention is disposed upside down in the anti-dust cover 1701. A hollow frame 1703 has one end joined to the bottom of the reflector A01. The hollow frame 1703 can be rectangular or cylindrical shaped. The hollow frame 1703 has another end joined to a lens 1704, whereby light reflected by the reflector A01 is refracted by the lens 1704 to a illuminating region. The anti-dust cover 1701 further includes a through hole or movable closing structure for maintenance or replacement.

Each of the inclined surfaces or the curved reflecting surfaces is enlarged in the figures of the invention for clarity. In real application, many tiny inclined surfaces or curved surfaces are connected to each other to form a curve surface.

The lamp of the invention is particularly suitable for head light of vehicles to reflect light from a light source to become effective illuminating light and prevent light from dazzling a driver in a coming car. The lamp of the invention can also be applied to road lamp and disposed on guardrails on a rod shoulder.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A reflecting structure for a lamp, comprising:

at least one light source; and a reflector, in which the light source is disposed to emit light, comprising at least one light intercepting plate and a main body, wherein the light intercepting plate comprises an inner surface which is a plane serving as a light intercepting surface intercepting the light from the light source, at least one reflecting surface extending from the light intercepting surface and perpendicularly toward an outer surface of the light intercepting plate and at least one positioning structure; the main body is joined to the light intercepting surface and comprises at least two convex curved surfaces disposed on two opposite sides of a vertical line extending through the light source to reflect light from the light source directly and the light reflected by the light intercepting surface.

2. The reflecting structure as claimed in claim 1, wherein each of the convex curved surface comprises a plurality of curved surfaces connected to each other, each of the curved surfaces has an inclined angle different from the inclined angle of others of the curved surfaces, each of the curved surfaces is disposed horizontally and curved from a bottom to a central line of the reflector, the curved surface is gradually inclined toward a base point from the curved surface disposed in the most top position to a curved surface in the most bottom position, the base point is formed by a vertical line parallel to a vertical central line of the light source intersecting a lower edge of the reflector, the inclined angle and a length of the curved surface is gradually decreased from the curved surface disposed in the most top position to a curved surface in the most bottom position, and the main body comprises at least one positioning structure.

3. The reflecting structure as claimed in claim 1, wherein the light intercepting surface comprises at least one horizontal light intercepting surface and at least one inclined light intercepting surface, the inclined light intercepting surface comprises a conical curved reflecting surface, the conical reflecting surface comprises a plurality of arced inclined surface connected to each other, each of the arced inclined surface has an inclined angle different from the inclined angle of other of the arced inclined surfaces, the inclined angle of the arced inclined surface is gradually increased from the bottom of the reflector to the arced inclined surface in a top position of the conical reflecting surface.

4. The reflecting structure as claimed in claim 1, wherein the light intercepting plate comprises at least one horizontal light intercepting surface and at least one vertical stepped light intercepting surface perpendicular to the horizontal light intercepting surface and disposed on an inner surface of a bottom of the light intercepting plate.

5. The reflecting structure as claimed in claim 1, wherein the reflecting surface is an arced surface.

6. The reflecting structure as claimed in claim 1, wherein the reflecting surface is a curved surface.

7. The reflecting structure as claimed in claim 1, wherein the reflecting surface comprises at least two convex curved surfaces disposed on opposite sides of a vertical line extending through the light source, each of the convex curved surface comprises a plurality of curved surfaces connected to each other, each of the curved surfaces has an inclined angle different from the inclined angle of others of the curved surfaces, each of the curved surfaces is disposed horizontally and curved from a bottom to a central line of the reflector, the curved surface is gradually inclined toward a base point from the curved surface disposed in the most bottom position to a curved surface in the most top position, the base point is formed by a vertical line parallel to a vertical central line of the light source intersecting a lower edge of the reflector, the inclined angle of the curved surface is gradually increased from the curved surface disposed in the most bottom position to a curved surface in the most top position, and a length of the curved surface is gradually decreased from the curved surface disposed in the most bottom position to a curved surface in the most top position.

8. The reflecting structure as claimed in claim 7, wherein the reflecting surface further comprises a stripped reflecting surface disposed between the convex curved surfaces, the stripped reflecting surface comprises a plurality of inclined surfaces connected to each other, each of the inclined surfaces has an inclined angle different from the inclined angle of others of the inclined surfaces, and the inclined angle of the inclined surface is gradually increased from the inclined surface in the most bottom position to the inclined surface in the most top position.

9. The reflecting structure as claimed in claim 7, wherein the reflecting surface further comprises an arced surface connecting the convex curved surfaces disposed in a top position of the light intercepting plate.

10. The reflecting structure as claimed in claim 1, wherein the reflecting surface comprises at least one arced surface and at least one convex curved surface extending from the light intercepting surface perpendicularly toward an outer surface of the light intercepting plate, the convex curved surface is disposed on a lateral side of a vertical light intercepting surface extending through a plurality of vertical lines parallel to a vertical line extending through the light source and perpendicular to the light intercepting surface, the convex curved surface comprises a plurality of curved surfaces connected to each other, each of the curved surface is disposed horizontally, curved from a bottom of the reflector to a central line of the reflector, and has an inclined angle different from the inclined angle of others of the curved surface, the curved surface is gradually inclined toward a base point from the curved surface disposed in the most bottom position to a curved surface in the most top position, the base point is formed by a vertical line parallel to a vertical central line of the light source intersecting a lower edge of the reflector, the inclined angle of the curved surface is gradually increased from the curved surface disposed in the most bottom position to a curved surface in the most top position, and a length of the curved surface is gradually decreased from the curved surface disposed in the most bottom position to a curved surface in the most top position.

11. The reflecting structure as claimed in claim 1, wherein the main body further comprises an arced surface connecting the convex curved surfaces.

12. The reflecting structure as claimed in claim 1, wherein the main body further comprises a stripped reflecting surface disposed between the convex curved surfaces and connecting the convex curved surfaces, the stripped reflecting surface comprises a plurality of inclined surfaces, each of the inclined surface has an inclined angle different from the inclined angle of others of the inclined surfaces, and the inclined angle of the inclined surface is gradually increased from the inclined surface in the most bottom position to the inclined surface in the most top position.

13. The reflecting structure as claimed in claim 12, wherein the main body further comprises an arced surface connecting the convex curved surfaces and the stripped reflecting surface.

14. The reflecting structure as claimed in claim 1, wherein the light intercepting plate comprises at least one positioning structure, each of the convex curved surfaces comprises a positioning structure, the light intercepting plate and one of the convex curved surfaces of the main body is fixed to an anti-dust cover comprising at least one optical transparent plate, the other convex curved surface is movably disposed on the positioning structure and connected to a solenoid valve.

15. The reflecting structure as claimed in claim 1, wherein the reflector comprises a decoration panel disposed on a bottom of the reflector and extending outward, and a warning light source is disposed on the decoration panel.

16. The reflecting structure as claimed in claim 1, wherein the reflector comprises at least one positioning structure comprising through holes for mounting the light source.

17. The reflecting structure as claimed in claim 1, wherein the light intercepting plate is integrated with the main body and comprises at least one positioning structure.

18. The reflecting structure as claimed in claim 1, wherein the reflector is assembled with at least one light emitting module.

19. The reflecting structure as claimed in claim 1, wherein the reflector is assembled with at least one transparent plate.

20. The reflecting structure as claimed in claim 1, wherein the reflector has a stepped structure on a bottom of the reflector.

21. The reflecting structure as claimed in claim 1, wherein the reflector comprises a plurality of fins disposed on the outer surface of the light intercepting plate.

22. The reflecting structure as claimed in claim 1, wherein the reflector is disposed upside down in an anti-dust cover comprising at least one transparent plate.

23. The reflecting structure as claimed in claim 22, wherein the reflector is assembled with an end surface of a hollow frame, and another end surface of the hollow frame is assembled with a lens.

* * * * *